US008844616B2

(12) United States Patent
Krohn et al.

(10) Patent No.: US 8,844,616 B2
(45) Date of Patent: Sep. 30, 2014

(54) METHOD FOR WITHDRAWAL AND INSERTION OF A DRILL PIPE STRING IN A BOREHOLE AND ALSO A DEVICE FOR USE WHEN PRACTICING THE METHOD

(75) Inventors: Helge Krohn, Sandnes (NO); Mads Grinrød, Stavanger (NO)

(73) Assignee: West Drilling Products AS, Stavanger (NO)

( * ) Notice: Subject to any disclaimer, the term of this patent is extended or adjusted under 35 U.S.C. 154(b) by 502 days.

(21) Appl. No.: 13/203,212

(22) PCT Filed: Feb. 19, 2010

(86) PCT No.: PCT/NO2010/000065

§ 371 (c)(1),
(2), (4) Date: Sep. 19, 2011

(87) PCT Pub. No.: WO2010/098672

PCT Pub. Date: Sep. 2, 2010

(65) Prior Publication Data

US 2012/0000671 A1 Jan. 5, 2012

(30) Foreign Application Priority Data

Feb. 26, 2009 (NO) ..... 20090898

(51) Int. Cl.

| | |
|---|---|
| ***E21B 19/18*** | (2006.01) |
| ***E21B 19/16*** | (2006.01) |
| ***E21B 3/02*** | (2006.01) |
| ***E21B 19/14*** | (2006.01) |

(52) U.S. Cl.

CPC . *E21B 19/16* (2013.01); *E21B 3/02* (2013.01); *E21B 19/14* (2013.01)

USPC ..... 166/77.52

(58) Field of Classification Search

USPC ..... 175/85, 161, 162; 414/22.51; 166/77.51, 77.52, 85.1, 377

See application file for complete search history.

(56) References Cited

U.S. PATENT DOCUMENTS

| | | | | | |
|---|---|---|---|---|---|
| 3,158,212 | A * | 11/1964 | Fanshawe et al. | ..... | 175/85 |
| 3,533,516 | A * | 10/1970 | Guier | ..... | 414/22.51 |
| 3,760,658 | A | 9/1973 | Guier | | |
| 4,023,449 | A | 5/1977 | Boyadjieff | | |
| 5,060,542 | A | 10/1991 | Hauk | | |
| 6,581,698 | B1 * | 6/2003 | Dirks | ..... | 175/52 |
| 2005/0126792 | A1 | 6/2005 | Berry | | |
| 2008/0307930 | A1 | 12/2008 | Veverica et al. | | |

FOREIGN PATENT DOCUMENTS

| | | | |
|---|---|---|---|
| CA | 2207832 | C | 8/2006 |
| EP | 1980709 | A1 | 10/2008 |
| SE | 450144 | B | 6/1987 |
| WO | 03/102350 | A2 | 12/2003 |
| WO | 03/102350 | A3 | 7/2004 |
| WO | 2005/056975 | A1 | 6/2005 |

OTHER PUBLICATIONS

International Search Report for parent application PCT/NO2010/000065, having a mailing date of Jun. 3, 2010.

International Preliminary Report on Patentability for parent application PCT/NO2010/000065, having a completion date of Jan. 20, 2011.

Written Opinion for parent application PCT/NO2010/000065, having a mailing date of Jun. 3, 2010.

* cited by examiner

*Primary Examiner* — David Andrews
*Assistant Examiner* — Ronald Runyan
(74) *Attorney, Agent, or Firm* — Andrus Intellectual Property Law, LLP

(57) ABSTRACT

A device for tripping, in which, at a drill-floor opening which is arranged to receive a pipe string, two or more cooperating pipe-handling units are arranged, each, independently of the other(s) or in cooperation with the other(s), being arranged to releasably hold the pipe string fixed and to move the pipe string in its axial direction, and also to move a pipe section in the axial direction of the pipe string and rotate the pipe section around the axis of the pipe string.

11 Claims, 2 Drawing Sheets

METHOD FOR WITHDRAWAL AND INSERTION OF A DRILL PIPE STRING IN A BOREHOLE AND ALSO A DEVICE FOR USE WHEN PRACTICING THE METHOD

CROSS-REFERENCE TO RELATED APPLICATIONS

This application is the U.S. national stage application of International Application No. PCT/NO2010/000065, filed Feb. 19, 2010, which International application was published on Sep. 2, 2010 as International Publication No. WO 2010/098672 A1 in the English language and which application is incorporated herein by reference. The International application claims priority of Norwegian Patent Application No. 20090898, filed Feb. 26, 2009, which application is incorporated herein by reference.

BACKGROUND

There is described a device for running a pipe string, more particularly by there being arranged, at a drill-floor opening which is arranged to receive a pipe string, at least two cooperating pipe-handling units, each, independently of the other or in cooperation with the other, arranged to releasably hold the pipe string fixed and to move the pipe string in its axial direction, and also to move a pipe section in the axial direction of the pipe string and rotate the pipe section around the axis of the pipe string.

Through the change from manual to mechanized and remote-operated pipe handling on drilling installations arranged for exploration and production drilling for, inter alia, oil and gas, the efficiency during the insertion or the withdrawal of the drill string, so-called running of the drill string or "tripping", or the equivalent for other pipe strings, for example casing, has become considerably reduced. While, in manual make-up or break-out, it was normal to handle 60 pipe sections per hour, the capacity has now fallen by half. In deep-water drilling and in the drilling of increasingly longer wells, very long pipe strings are used today, and there is an increased need to reduce the time for insertion and pulling-out and reduce the costs of such operations.

By the techniques of today for inserting a drill string into the borehole, the drill string is constructed step by step from sections consisting of one, two or three joints of pipe. The part of the pipe string which has been moved down into the borehole (or down into a riser connecting the borehole to the surface installation when the drilling takes place at sea) has been hung off in the drill floor by means of a wedge mechanism (slips), and the pipe string is lengthened by a new pipe section being moved from a pipe rack down onto the pipe string and made up by means of a pipe tong while the pipe string is prevented from rotating by it being held fixed, at a portion projecting above the drill floor, by a back-up tong. When a new pipe section has been joined to the pipe string, the drill string is lowered by a length corresponding to that of the added pipe section and the process is repeated. When tripping out, this sequence of operations is reversed.

When the drill string is at a standstill for a pipe section to be added or removed, there is a risk that the drill string may stick in the borehole because of differential pressure in the borehole, or fragments from an open portion of the borehole coming loose and wedging against the drill string and so on. This risk may entail extra time expenditure to loosen the drill string; possibly, the drill string will have to be pulled out for damage to be repaired.

From WO 03/102350, there is known a drill-rig apparatus arranged for assembling and disassembling a well pipe, including a power tong arranged for the rotation of an upper pipe section, a back-up tong arranged for holding an underlying well pipe fixed, and a wedge arrangement arranged in the drill floor and arranged for the drill pipe to be hung off. The power tong and back-up tong can be moved in the axial direction of the well pipe.

CA 2207832 discloses a method of removing, from a well, a rod which is encased in jointed tubing; for example, a rod driving a downhole piston pump. It is described how pipe sections and rod sections, alternately, are broken out of the pipe string and rod, respectively, by means of a back-up tong and a power tong.

From WO2005/056975 is known a power tong with a non-divided drive ring surrounding the vertical centre axis of the drilling centre and the pipe string. The power tong, which cooperates with an underlying back-up tong, is movable in a vertical direction to the position of a pipe joint which is to be broken out or joined.

U.S. Pat. No. 5,060,542 discloses a power tong including three gripping jaws, of which only a combination of two is functional at all times when a pipe string is to be assembled or disassembled. This is achieved by the power tong being vertically movable to position the desired pair of gripping jaws at the pipe joint.

In what follows, the terms "pipe string" and "pipe section" are not restricted to a drill string or casing, but cover all types of pipes that are made up of stands of pipe sections that are joined on a drilling installation and are gradually moved downwards as the length of the pipe increases.

SUMMARY

The invention has for its object to remedy or reduce at least one of the drawbacks of the prior art.

The object is achieved through features which are specified in the description below and in the claims that follow.

The invention relates to a device for tripping, typically inserting and withdrawing a drill string into/from a borehole, or setting and possibly retrieving casing, in which at least two cooperating pipe-handling units are arranged at a drill-floor opening, each being arranged to hold the pipe string fixed, move the pipe string axially and to rotate and axially move a pipe section relative to the pipe string in order thereby to connect the pipe section to the pipe string and disengage the pipe section from the pipe string, respectively, all while the pipe string is being moved into the borehole or pulled out of the borehole, respectively, and the other pipe-handling unit(s) is (are) moved to an initial position to engage the subsequent pipe section which is to be added to the pipe string or be broken out of the pipe string, respectively, when the preceding pipe section is completely connected to the pipe string or disconnected from the pipe string, respectively. By this alternating action of the at least two pipe-handling units arranged according to the invention, the possibility of continuously running the pipe string during assembly or disassembly is provided, and thereby a greater capacity is achieved than that exhibited by prior-art mechanized tripping.

In a first aspect, the invention relates more specifically to a device for tripping, in which there are arranged, at a drill-floor opening which is arranged to receive a pipe string, two or more cooperating pipe-handling units, characterized by each pipe-handling unit, independently of the other(s) or in cooperation with the other(s), being arranged to releasably hold the pipe string or a pipe section fixed, and to move the pipe string or pipe section in its axial direction, and to rotate the pipe section around the axis of the pipe string during the axial movement of the pipe string.

The pipe-handling units may be provided with a pipe-gripping unit which is arranged to be disposed above the drill-floor opening and be moved in the axial direction of the pipe string, the pipe-gripping unit being provided with means arranged to be in releasable, rotationally rigid engagement with the pipe string and to carry the weight of the pipe string, and means arranged to rotate the pipe section, which is arranged on or at an end portion of the pipe string, around the axis of the pipe string and to move the pipe section in the axial direction of the pipe string.

The means of the pipe-gripping unit for holding the pipe string and pipe section fixed and rotating the pipe section may be arranged to be movable away from a path of motion of the other cooperating pipe-handling unit(s).

Each pipe-gripping unit may be connected to a hoisting device arranged to move the pipe-gripping unit and the fixed pipe string or the pipe section, respectively, in the axial direction of the pipe string.

At least one of the pipe-handling units may be provided with a pipe manipulator.

In a second aspect, the invention relates more specifically to a method of tripping, characterized by the method including the following steps:

a) a pipe string is releasably hung off in a first pipe-handling unit and moved down in the axial direction of the pipe string into a borehole;
b) a first pipe section is releasably hung off in a second pipe-handling unit;
c) said pipe section is moved with an end portion towards the pipe string to be connected to a corresponding end portion of the pipe string, the pipe section being rotated relative to the pipe string and moved axially until rotationally rigidly engaged with the pipe string, during the continued movement of the pipe string in its axial direction;
d) the first pipe-handling unit is disengaged from the pipe string during the continued movement of the pipe string in its axial direction to a position on the extension of the pipe string;
e) a second pipe section is releasably hung off in the first pipe-handling unit and is further handled as indicated for the first pipe section in step c);
f) the second pipe-handling unit is disengaged from the pipe string and operated as indicated for the first pipe-handling unit in step d); and
g) the steps b)-f) are repeated during the continued movement of the pipe string for a number of subsequent pipe sections until the pipe string exhibits the desired length.

The method may further include the step:

h) the pipe string is tripped out of the borehole by reversing the process specified in the steps a)-g).

BRIEF DESCRIPTION OF THE DRAWINGS

In what follows is described an example of a preferred embodiment which is visualized in the accompanying drawings, in which.

DETAILED DESCRIPTION OF THE DRAWINGS

Figure 1:
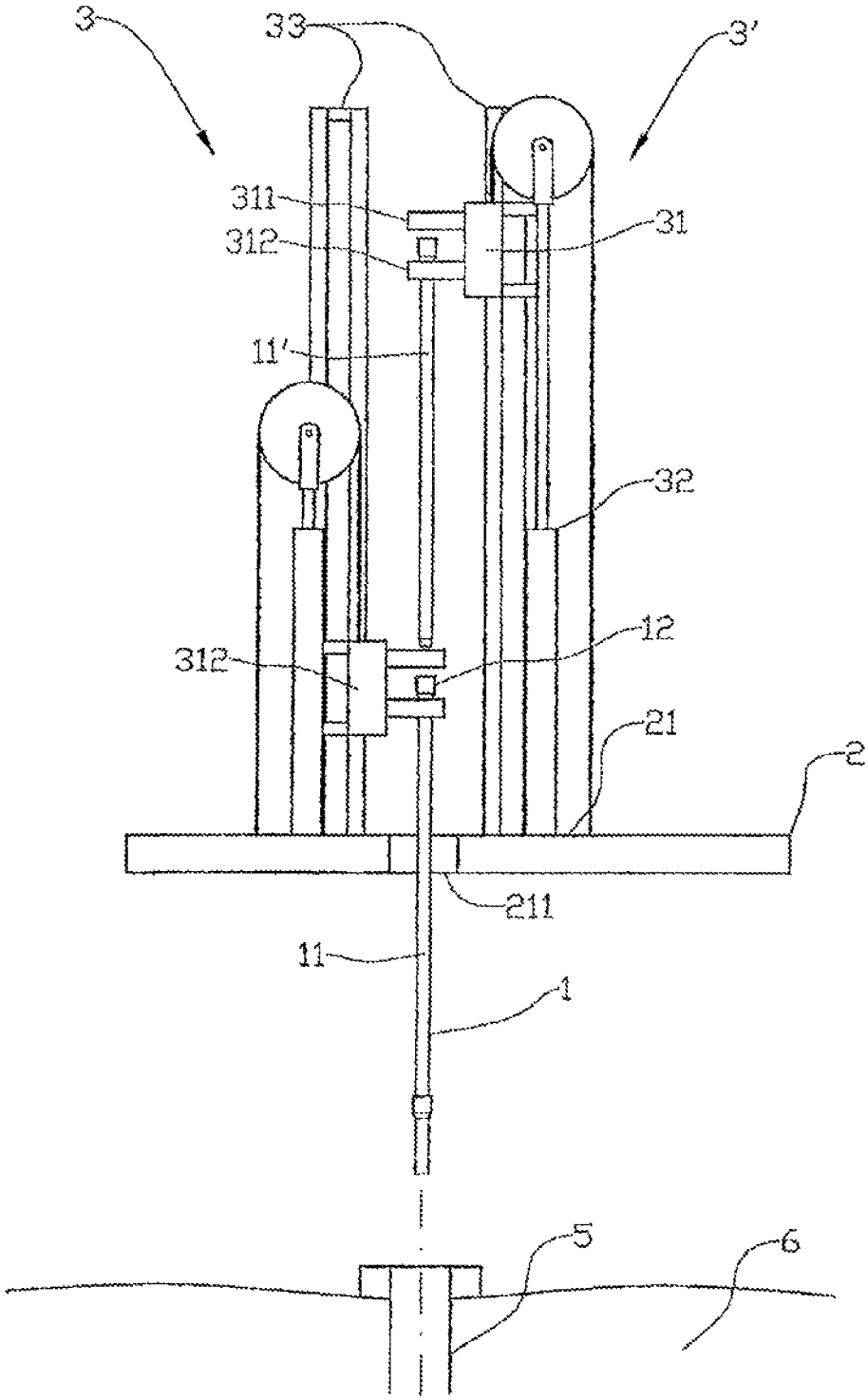
FIG. 1 shows a principle drawing of a device according to the invention in a side view.

On a drilling installation 2 including a so-called drill floor 21 with a drill-floor opening 211 arranged for passing devices that are used during the formation of a borehole 5 which extends downwards in an underground formation 6, there are arranged first and second pipe-handling units 3, 3'. From the drilling installation 2 down towards the borehole 5 extends a pipe string 1, known per se, arranged to move tools (not shown) for working the borehole 5, for example a so-called drill string with a drill bit. Alternatively, the pipe string 1 may be casing which is to be set in the borehole 5.

The pipe string 1 is assembled from a number of pipe sections 11, 11'. The reference numeral 11 indicates a first pipe section which has been joined to an end portion 12 of the pipe string 1, and the reference numeral 11' indicates a second pipe section following the first pipe section 11 in the pipe string 1. The pipe sections 11, 11' include means known per se for releasable joining, for example end portions with, respectively, internal and external threaded portions.

The pipe-handling units 3, 3' are functionally identical and each include a pipe-gripping unit 31 which is connected to a hoisting device 32 which is arranged to move the pipe-gripping unit 31 vertically along a pipe-tong guide 33.

The pipe-gripping unit 31 is provided with a power tong 311 which is arranged to rotate a pipe section 11, 11' relative to the pipe string 1 at a predetermined torque. A back-up tong 312 is arranged in connection with the power tong 311 in such a way that when the power tong 311 is positioned at a lower end portion of a pipe section 11, 11' which is to be joined to the pipe string 1 or broken out of the pipe string 1, the back-up tong 312 can be positioned at an area of the upper end portion 12 of the pipe string 1 suitable for the pipe string to be hung off by, typically right below the shoulder of a threaded box. The back-up tong 312 is arranged to releasably hold the pipe string 1 fixed as a pipe section 11, 11' is being made up to be joined to the pipe string 1 or broken out to be disassembled from the pipe string 1, and also to hang the pipe string 1 off in the pipe-handling unit 3, 3' in order thereby to be able to lower or lift the drill string 1 by means of the hoisting devices 32 of the pipe-handling unit 3, 3'. The pipe-gripping unit 31 is arranged in such a way that, at least in an operative position, the centres of the power tong 311 and the back-up tong 312 coincide with the centre axis of the pipe string 1.

Figure 2:
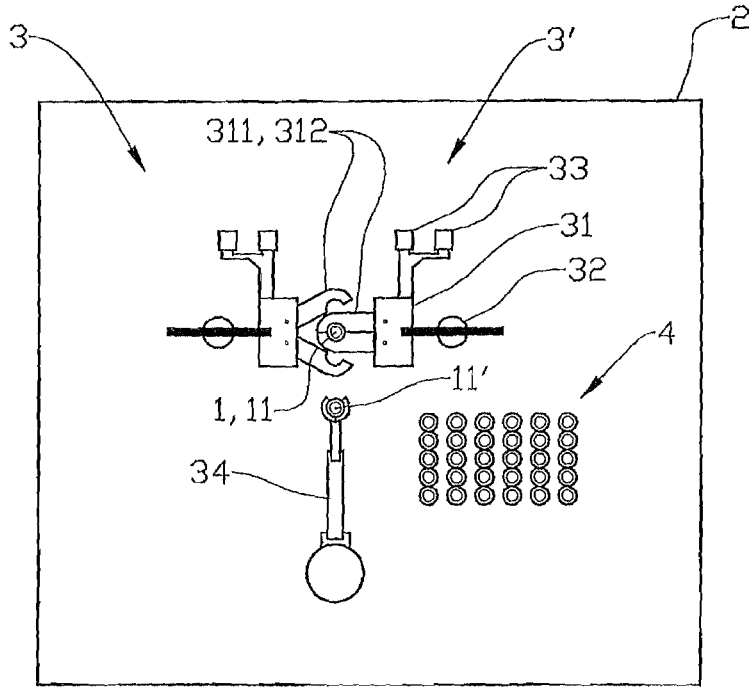
FIG. 2 shows a plan of the device of FIG. 1 and a pipe manipulator arranged to move pipe sections between a pipe rack and the centre of a drill floor.

The power tong 311 and the back-up tong 312 are arranged to be moved from their operative working area, radially away from the centre axis of the drill string 1, in order thereby to allow a pipe-gripping unit 31, when moving vertically, to pass the pipe-gripping unit 31 which is operatively engaged with the pipe string 1 or a pipe section 11, 11'. This is shown in principle in FIG. 2, in which the pipe-string encompassing parts of the power tong 311 and back-up tong 312 have been pivoted away from the pipe string 1.

A pipe manipulator 34 is arranged in such a way that the pipe sections 11, 11' can be moved between a pipe rack 4 and the work area of the pipe-handling units 3, 3', in order thereby to feed pipe sections 11, 11' to the pipe-handling units 3, 3' as the pipe string 1 is built, or remove pipe sections 11 as the pipe string 1 is disassembled.

Each pipe-handling unit 3, 3' is arranged to join a pipe section 11, 11' to the pipe string 1 while the pipe string 1 is continuously being moved down through the drill-floor opening 211, or disconnect a pipe section 11, 11' from the pipe string 1 while the pipe string 1 is continuously being moved up through the drill-floor opening 211.

Said joining during the continuous movement of the pipe string 1 is achieved by the pipe manipulator 34 placing the first pipe section 11 together with any attached tool, for example a drill bit on a drill-pipe section, at the centre of the drill floor 21, where the pipe-gripping unit 31 of the first pipe-handling unit 3 is positioned and, with the back-up tong 312, grips the upper end portion of the pipe section 11. The pipe-gripping unit 31 is moved downwards along the pipe-tong guide 33. At the same time, the gripping unit 31 of the second pipe-handling unit 3' moves upwards to receive the second pipe section 11', its back-up tong 312 gripping the upper end portion of the second pipe section 11'. The second pipe section 11' is moved into abutment against the upper end portion of the first pipe section 11 which is constantly moving downwards, and the power tong 311 of the pipe-gripping unit 31 of the first pipe-handling unit 3 grips the lower end portion of the second pipe section 11'. As the pipe-gripping unit 31 of the second pipe-handling unit 3' releases its firm grip around the second pipe section 11', but maintains a stabilizing position relative to the pipe section 11', the second pipe section 11' is set into a rotating motion by the power tong 311 of the first pipe-handling unit 3. When the joint has been made up to the prescribed torque, the pipe-gripping unit 31 of the second pipe-handling unit 3' again grips firmly around the second pipe section 11', whereas the first pipe-handling unit 3 is disengaged from the pipe string 1 and moved vertically to receive a new pipe section 11.

When tripping out and dismantling the pipe string 1, the operation as described above is reversed.

Through the cooperating movements and constant downward, alternatively upward, movement of the drill string 1, the desired effect is achieved, namely the assembling and the disassembling, respectively, of the pipe string without constant standstills in the pipe movement during the so-called tripping.

The invention claimed is:

1. A device used in insertion and withdrawal of a drill pipe string through an opening in a drill floor in registration with a borehole, the drill pipe string being formed by a series of aligned pipe sections having facing threaded upper and lower end portions directly connected together and defining a releasable joint between each pair of aligned pipe sections the device comprising:

at least two pipe-handling units mounted on a drilling installation independently of and cooperating with each other, wherein each pipe-handling unit includes a pipe-gripping unit mounted for movement above the drill floor in a direction along a longitudinal axis of the drill pipe string, each pipe-gripping unit being constructed with a first releasable gripping structure configured for fixed engagement with an upper end portion of a first pipe section for carrying the weight of the first pipe section or the drill pipe string, and a second releasable gripping structure configured for rotatable engagement with a lower end portion of a second pipe section aligned with the first pipe section for completely and independently connecting and disconnecting the threaded end portions of the aligned pipe sections as the drill pipe string is moved through the drill floor opening with the first pipe section being held fixed by only the first releasable gripping structure, the first and second releasable gripping structures each having gripping members engageable with the pipe sections and radially movable relative to each other; and a pipe manipulator mounted separately from the pipe-handling units and configured for use during assembly and disassembly of the drill pipe string to move a pipe section to be added to the drill pipe string or disconnected from the drill pipe string by means of the first releasable gripping structure between a pipe rack and an upper end of the drill pipe, wherein the pipe-handling units are arranged to allow one of the pipe-gripping units, when moving vertically, to pass though the other of the pipe-gripping units which is operatively engaged with the drill pipe string or one of the pipe sections.

2. The device of claim 1, wherein the first releasable gripping, structure and the second releasable gripping structure are separately actuable, and have center axes which remain aligned with the longitudinal axis of the drill pipe string.

3. The device of claim 1, wherein the first releasable gripping structure is a back-up tong having a single pair of gripping members, and the second releasable gripping structure is a power tong having a single pair of gripping members.

4. The device of claim 1, wherein the first releasable gripping structure and the second releasable gripping structure on one of the pipe-gripping units are configured for movement away from a path of motion of the first releasable gripping structure and the second releasable gripping structure on another of the pipe-gripping units.

5. The device of claim 1, wherein each pipe-gripping unit is connected to a hoisting device arranged to move the pipe-gripping unit and the drill pipe string or pipe section in the direction of the longitudinal axis of the drill pipe string.

6. The device of claim 1, wherein each pipe-handling unit is arranged to join a pipe section to the drill pipe string while the drill pipe string is continuously moved down through the drill floor opening, or disconnect the pipe section from the drill pipe string while the drill pipe string is continuously moved up through the drill floor opening.

7. The device of claim 1, wherein each pipe-gripping unit is mounted for vertical movement along a pipe tong guide continuously fixed to the drill floor.

8. A method of assembling a drill pipe string, the method comprising the steps of:

a) providing at least first and second pipe-handling units mounted on a drilling installation independently of and cooperating with each other, wherein each pipe-handling unit includes a pipe-gripping unit mounted for movement along a longitudinal axis defining a drill pipe string axis, each pipe-gripping unit being constructed with a first releasable gripping structure spaced apart from a second releasable gripping structure, the first and second releasable gripping structures being separately actuable and having gripping members engageable with the drill pipe string and radially movable relative to each other and having center axes which remain aligned with the drill pipe string axis;

b) providing a pipe manipulator mounted separately from the pipe-handling units for transferring pipe sections to be added to the drill pipe string between a rack and the drill pipe string;

c) releasably hanging a drill pipe string from the first releasable gripping structure of the first pipe-handing unit, and moving the drill pipe string down along the drill pipe string axis into a borehole;

d) releasably hanging, a first pipe section transferred by the pipe manipulator from the first releasable gripping structure of the second pipe-handling unit in alignment with the drill pipe string;

e) moving an end section of the first pipe section towards the drill pipe string for connection with a corresponding end portion of the drill pipe string, the first pipe section being rotated by the second releasable gripping structure on the first pipe-handing unit as the first releasable gripping structure on the second pipe-handling unit is partially released so as to completely and independently connect the end portions of the first pipe section and the drill pipe string together into rotationally rigid engagement during movement of the drill pipe string along the drill pipe string axis;

f) gripping the first pipe section with the first releasable gripping structure on the second pipe-handling unit after the first pipe section has been connected to the drill pipe string;

g) disengaging, the first and second releasable gripping structures on the first pipe-handling unit from the drill pipe string during the continued downward movement of the drill pipe string along the drill pipe string axis;

h) releasably hanging a second pipe section transferred by the pipe manipulator from the first releasable gripping structure of the first pipe-banding unit, and further handling the second pipe section similarly to the first pipe section in step e);

i) disengaging the first and second releasable gripping structures of the second pipe-handling unit from the drill pipe string and operating the second pipe-handling unit similarly to the first pipe-handling unit in step g); and j) repeating steps c)-i) for a subsequent number of pipe sections until the drill pipe string exhibits a desired length, wherein the pipe-handling units are arranged to allow one of the pipe-gripping units, when moving vertically, to pass though the other of the pipe-gripping units which is operatively engaged with the drill pipe string or one of the pipe sections.

9. The method of claim 8, wherein the method further comprises the step of:

k) withdrawing the drill pipe string out of the borehole by repeating the steps a)-j).

10. A device used in insertion and withdrawal of a drill pipe string through an opening in a drill floor in registration with a borehole, the drill pipe string being formed by a series of aligned pipe sections having facing threaded upper and lower end portions directly connected together and defining a releasable joint between each pair of aligned pipe sections, the device comprising:

at least two pipe-handling units mounted on a drilling installation independently of and cooperating with each other, wherein each pipe-handling unit includes a pipe-gripping unit mounted for movement above the drill floor in a direction along a longitudinal axis of the drill pipe string, each pipe-gripping unit being constructed with a first releasable gripping structure configured for fixed engagement with an upper end portion of a first pipe section for carrying the weight of the first pipe section or the drill pipe string, and a second releasable gripping structure configured for rotatable engagement with a lower end portion of a second pipe section aligned with the first pipe section for completely and independently connecting and disconnecting the threaded end portions of the aligned pipe sections as the drill pipe string is moved through the drill floor opening with the first pipe section being held fixed by only the first releasable gripping structure; and a pipe manipulator mounted separately from the pipe-handling units and configured for use during assembly and disassembly of the drill pipe string to move a pipe section to be added to the drill pipe string or disconnected from the drill pipe string by means of the first releasable gripping structure between a pipe rack and an upper end of the drill pipe, wherein the first releasable gripping structure is a back-up tong having a single pair of gripping members, and the second releasable gripping structure is a power tong having a single pair of gripping members.

11. A method of assembling a drill pipe string, the method comprising the steps of:

a) providing at least first and second pipe-handling units mounted on a drilling installation independently of and cooperating with each other, wherein each pipe-handling unit includes a pipe-gripping unit mounted for movement along a longitudinal axis defining a drill pipe string axis, each pipe-gripping unit being constructed with a first releasable gripping structure spaced apart from a second releasable gripping structure, the first and second releasable gripping structures being separately actuable and having center axes which remain aligned with the drill pipe string axis, wherein the first releasable gripping structure is a back-up tong having a single pair of gripping members, and the second releasable gripping structure is a power tong having a single pair of gripping members;

b) providing a pipe manipulator mounted separately from the pipe-handling units for transferring pipe sections to be added to the drill pipe string between a rack and the drill pipe string;

c) releasably hanging a drill pipe string from the first releasable gripping structure of the first pipe-handing unit, and moving the drill pipe string down along the drill pipe string axis into a borehole;

d) releasably hanging a first pipe section transferred by the pipe manipulator from the first releasable gripping structure of the second pipe-handling unit in alignment with the drill pipe string;

e) moving an end section of the first pipe section towards the drill pipe string for connection with a corresponding end portion of the drill pipe string, the first pipe section being rotated by the second releasable gripping structure on the first pipe-handing unit as the first releasable gripping structure on the second pipe-handling unit is partially released so as to completely and independently connect the end portions of the first pipe section and the drill pipe string together into rotationally rigid engagement during movement of the drill pipe string along the drill pipe string axis;

f) gripping the first pipe section with the first releasable gripping structure on the second pipe-handling unit after the first pipe section has been connected to the drill pipe string;

g) disengaging the first and second releasable gripping structures on the first pipe-handling unit from the drill pipe string during the continued downward movement of the drill pipe string along the drill pipe string axis;

h) releasably hanging a second pipe section transferred by the pipe manipulator from the first releasable gripping structure or the first pipe-handing unit, and further handling the second pipe section similarly to the first pipe section in step e);

i) disengaging the first and second releasable gripping structures of the second pipe-handling unit from the drill pipe string and operating the second pipe-handling unit similarly to the first pipe-handling unit in step g); and j) repeating steps c)-i) for a subsequent number of pipe sections until the drill pipe string exhibits a desired length.

* * * * *